US005453067A

United States Patent [19]

Cianfrocca, II

[11] Patent Number: 5,453,067

[45] Date of Patent: Sep. 26, 1995

[54] REVERSE GRIP TRICEP PUSH-DOWN BAR

[75] Inventor: Lawrence D. Cianfrocca, II, 402 Potomac Ave., Fairmont, W. Va. 26554

[73] Assignee: Lawrence D. Cianfrocca, II, Fairmont, W. Va.

[21] Appl. No.: 192,583

[22] Filed: Feb. 7, 1994

[51] Int. Cl.[6] ..... A63B 21/062

[52] U.S. Cl. ..... 482/99; 482/139

[58] Field of Search ..... 482/99, 100, 101, 482/102, 103, 139

[56] References Cited

U.S. PATENT DOCUMENTS

| | | | |
|---|---|---|---|
| 3,850,431 | 11/1974 | Winans | 482/99 |
| 4,349,191 | 9/1982 | Lambert, Jr. et al. | 482/100 |
| 4,456,245 | 6/1984 | Baldwin | 482/100 |
| 4,949,951 | 8/1990 | Deola | 482/100 |
| 5,273,509 | 12/1993 | Vittone | 482/139 |
| 5,300,003 | 4/1994 | Hull | 482/99 |

*Primary Examiner*—Lynne A. Reichard

[57] ABSTRACT

The application discloses an apparatus for an exercise machine having a force resistor such as the cable type wherein a weight stack supplies resistance to movement of this apparatus along an inward arcing path from an interconnecting cable system and the handles includes grips supported on extended arms, while the bottom support arms include properly placed plates to which arm pads are affixed and all arms be supported by a single member to which an angle of proper degree near the top of this single member will allow transfer of center of gravity to be directed inward towards user, thus keeping this apparatus in constant contact with the users hands, wrist or forearms area.

9 Claims, 4 Drawing Sheets

FIG.4—A
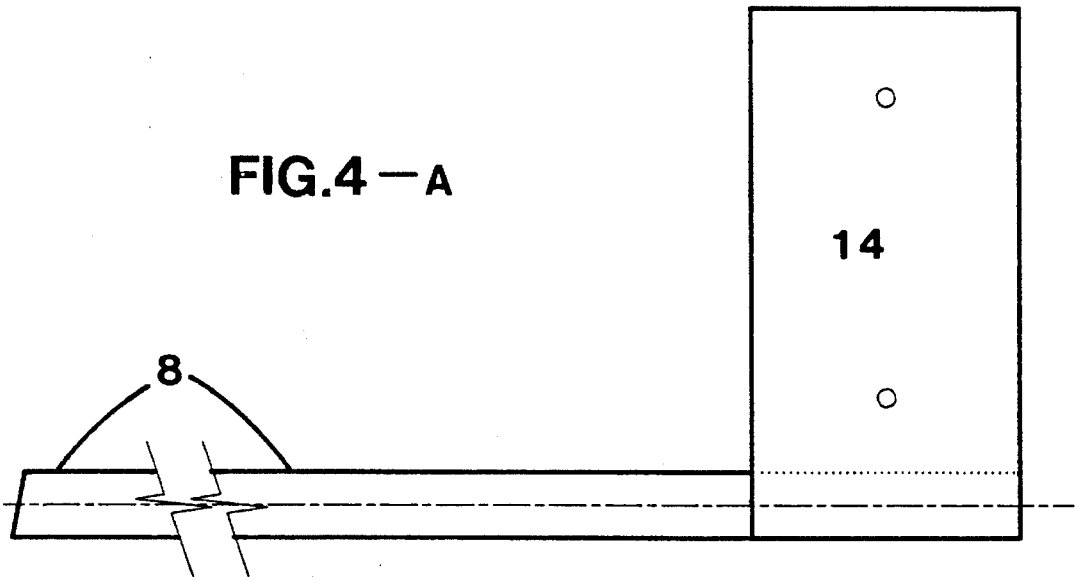
FIG.4—B
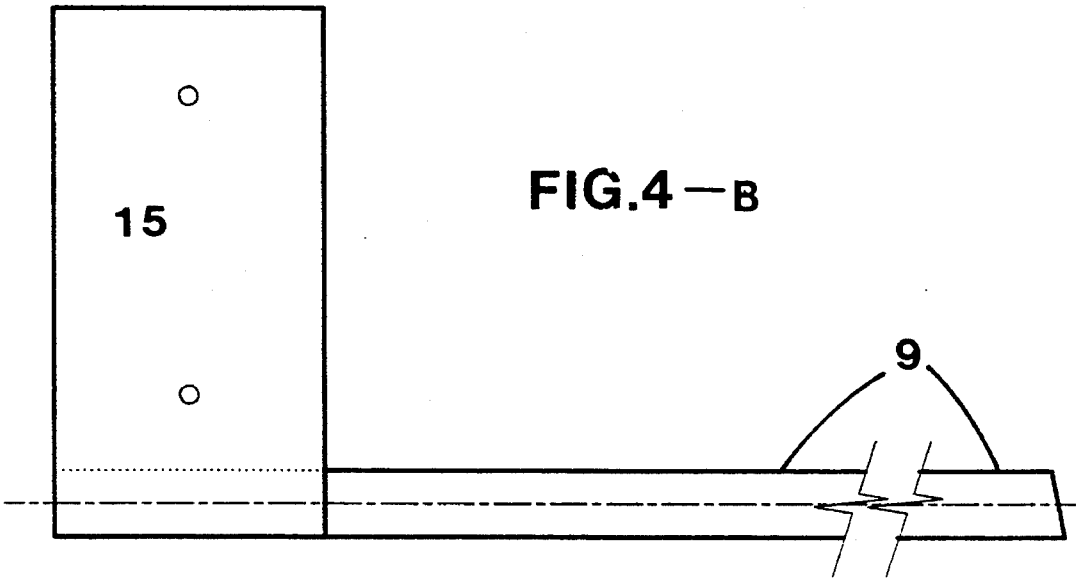

REVERSE GRIP TRICEP PUSH-DOWN BAR

BACKGROUND OF THE INVENTION

1. Field of the Invention

The invention relates to a method and apparatus for building the tricep muscle of the back of the upper arm. More particularly, the present invention relates to a portable apparatus which can easily be connected to any cable stack weight machine, for example, a Nautilus lat machine pull down using the cable machine, not having to be a nautilus it can be a cable system for pulling down from overhead.

2. Description of the Prior Art

The tricep muscle, which is located in the upper arm, the back of the arm, has three heads, inner, middle, and outer portion of the tricep. To build the back of the arm, which is the tricep muscle, one can use an exercise called a push down, basically used with a cable system, which is pushed down from above your eyes or head, and pushed down towards the floor, not being pulled from the floor up. This exercise builds the back of the arm or the tricep muscle when done correctly. The traditional way being palms down on the bar, with the bar connected to the cable, back of the hand facing up keeping your elbows close to your sides and at a stationery position and just moving hands and forearms down using the weight of the machine which is connected to the cable and then connected to the bar, that is the traditional way. This hits more of the outside and middle of the tricep muscle. Now to perform this exercise in a different way, and to hit the inner head of the tricep muscle, one should perform this exercise using a reversed grip push down which is, palms facing up while gripping the bar, the back of the hand facing down towards the floor and keeping the elbows stationery, forearms and hands moving only, pushing down. The problem is you can't use a heavy enough weight as with the palms facing down and the back of the hand facing up in the traditional way, because with the back of the hand facing down, the palms facing up, which is a reversed grip tricep push down, you don't have an adequate grip using a heavy enough weight, because one has a tendency to loose their grip because of the weight being heavy enough to adequately work the tricep muscle. The tricep muscle, being the largest part of the upper arm, and being very strong compared to the wrist and grip in using push-down movement, it has a tendency to put alot of extra strain and discomfort on the wrist area, using this reverse grip tricep push down going with the traditional bars.

The methods and apparatus described in this patent are to allow for a better grip and support for the wrist because you have the added padding and the stability and proper angle from the apparatus. The back of the wrist, which would be the back hand part of the wrist, and you have the stability using the apparatus because it has constant contact against the back of your hand, the back of your wrist, part of your forearm area, while you are still maintaining a hands on grip or fingers around the handle part of this apparatus, therefore your hands, your grip and your wrist are in constant contact with this apparatus while performing the tricep push down movement and it gives you an added safety for not straining the wrist, and also added safety for not loosing your grip.

SUMMARY OF THE INVENTION

The present invention provides an apparatus and method, which is useful for training the inner head of the tricep muscle.

Which allows for the use of adequate resistance to build the inner head of the tricep muscle and add safety.

Therefore allowing the use of heavy weight, not loosing ones grip, not straining ones wrist, while performing this movement or exercise.

This reverse grip tricep push down apparatus not only allows direct workout for the inner tricep muscle, it also works the middle and outer tricep muscle affective.

BRIEF DESCRIPTION OF THE DRAWINGS

The present invention can be better understood by reference to the drawings in which:

FIG. 4-A is a down view of bottom beam and plate without hand-wrist pads of the apparatus of the present invention.

FIG. 4-B is a down view of bottom beam and plate without hand-wrist pads of the apparatus of the present invention.

DESCRIPTION OF THE PREFERRED EMBODIMENT

Generally the apparatus of the present invention includes a means for developing the tricep muscles of the upper arms by means of the proper angle, stability, and safety from this apparatus of the present invention.

Figure 2:
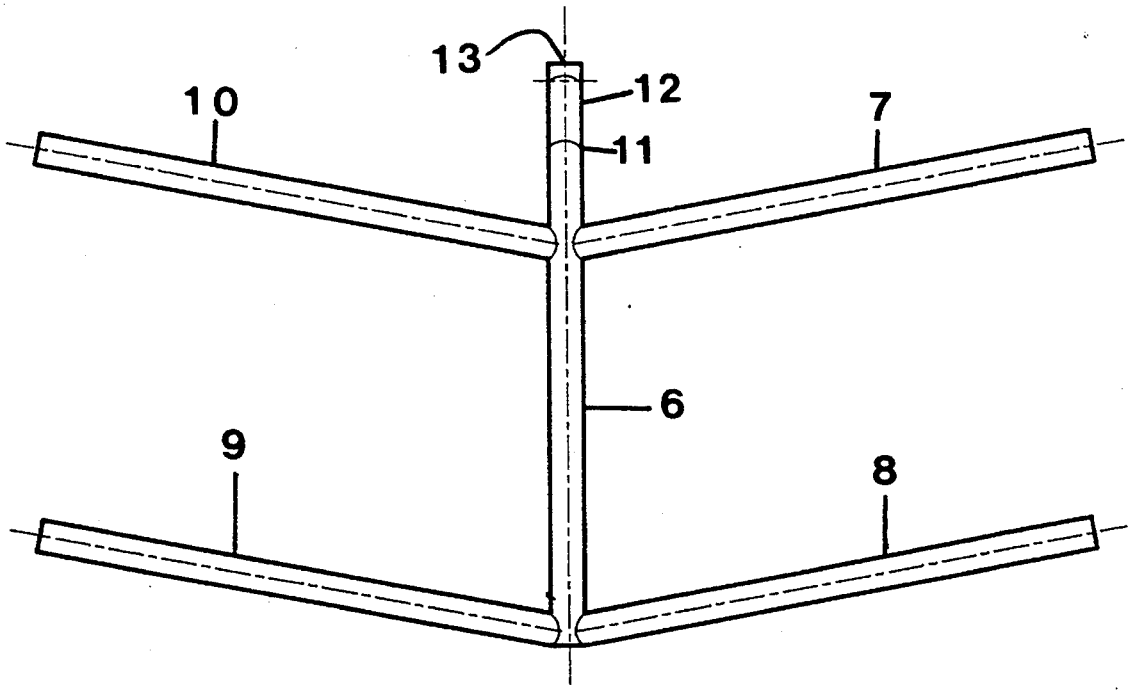
FIG. 2 is a front view without hand-wrist pads.

Referring now to FIG. one, a general overall view of the apparatus of the present invention is shown, the apparatus includes a vertical member, number 6, which is the main support for this apparatus which, as illustrated in FIG. 2, is attached on the upper right side is an upward 11½ degree angled beam number 7, and directly opposite this number 7 beam is number 10 beam which is also connected to main support member number 6 and number 10 beam will have the same 11½ degree upward angle as number 7 beam; as illustrated in FIG. 2, the reason for the angles in number 7 and number 10 is that it enables the user's wrist and elbow to be supported in a more comfortable position, while still producing this reverse grip motion.

Referring to FIG. 2 is the right bottom beam number 8 which is attached to main support member number 6, this bottom right beam number 8 is angled upward 11½ degrees as to enable the user's wrist and elbow to be supported in a more comfortable position while still producing this reverse grip motion.

Exactly opposite beam number 8, and attached to main support member number 6, is the left bottom beam number 9 which will be angled upward 11½ degrees as to enable the user's wrist and elbow to be supported in a more comfortable position while still producing the reverse grip motion as illustrated in FIG. 2. Beams number 7, 8, 9 and 10 should have a desired length of at least 10 inches, so as to allow for proper distance of hand spacing for any size user.

Figure 1:
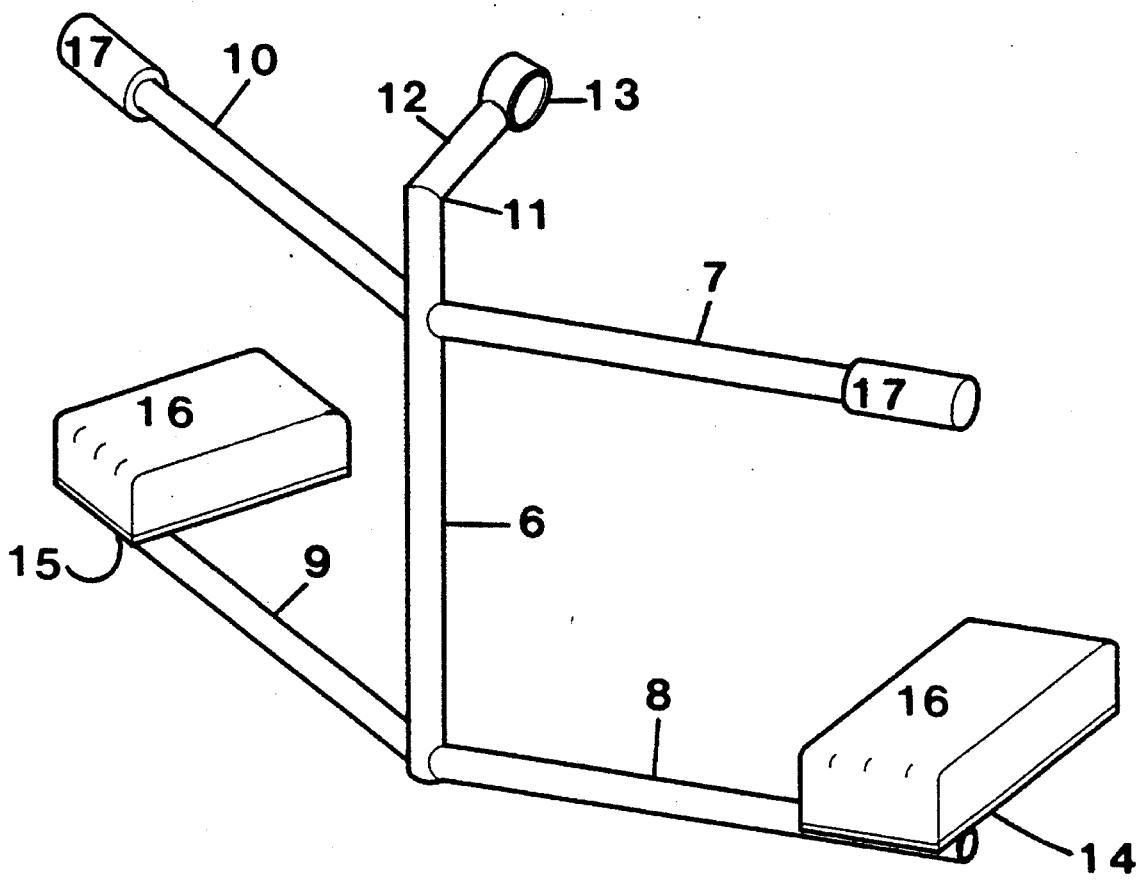
FIG. 1 is an overall complete view of the apparatus of the present invention.
Figure 3:
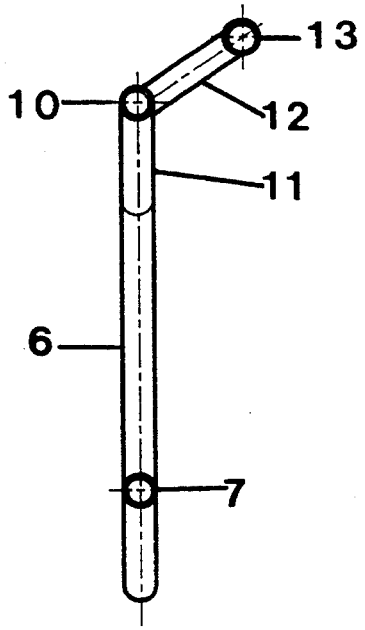
FIG. 3 is a side view without hand-wrist pads of the apparatus of the present invention.

Referring to FIG. 3 being vertical main support member number 6 will have a desired length of at least 8⅜ inches, including the fastening ring, FIG. 1 number 13.

Referring to FIG. 3 and referring to number 12 is one in the same with vertical main support member number 6, this number 12 is just a bend or angle upward from a horizontal position of about 40 degrees, the reason for this 40 degree angle changes the center of gravity from a downward straight motion to a inward arc motion, which keeps this apparatus in constant contact with the user's forearm and grip thus producing a more stabilized and safer grip allowing the use of heavier resistance.

Referring to FIG. 1 and number 11 is where the bend or angle should begin to complete this 40 degree angle in FIG. 1 number 12, the reason for the bend starting at this portion of the apparatus, FIG. 1 number 11, is to allow the center of gravity to be above beams, FIG. 1 numbers 7, 8, 9 and 10, thus allowing this apparatus to rotate inwards toward user. Referring to FIG. 3 the distance between number 11 and number 13 should be about 1½ inches as to allow for proper center of gravity transfer.

Referring to FIG. 4-A is the bottom right beam number 8 and connected to the beam is a plate number 14 that will be connected to beam number 8 at about a 20 degree angle, upward, this 20 degree angled plate is obtained by starting at a horizontal level position and said plate will be connected from the end and top portion (end being where beam ends into atmosphere) of said beam inward towards vertical member, FIG. 2 number 6, this plate FIG. 4-A number 14 will be about 2 to 3 inches in width and about 6 to 7 inches in length and thickness of plate should be as to give adequate strength as to not bend or break under heavy resistance.

Referring to FIG. 4-B is the bottom left beam number 9 and connected to the beam is a plate number 15 that will be connected to beam number 9 at about a 20 degree angle upward, this 20 degree angled plate is obtained by starting at a horizontal level position and said plate will be connected from the end and top position (end being where beam ends into atmosphere) of said beam inward toward vertical member FIG. 2 number 6, this plate FIG. 4-B number 15 will be about 2 to 3 inches in width and about 6 to 7 inches in length and thickness of plate should be as to give adequate strength as to not bend or break under heavy resistance.

Figure 5:
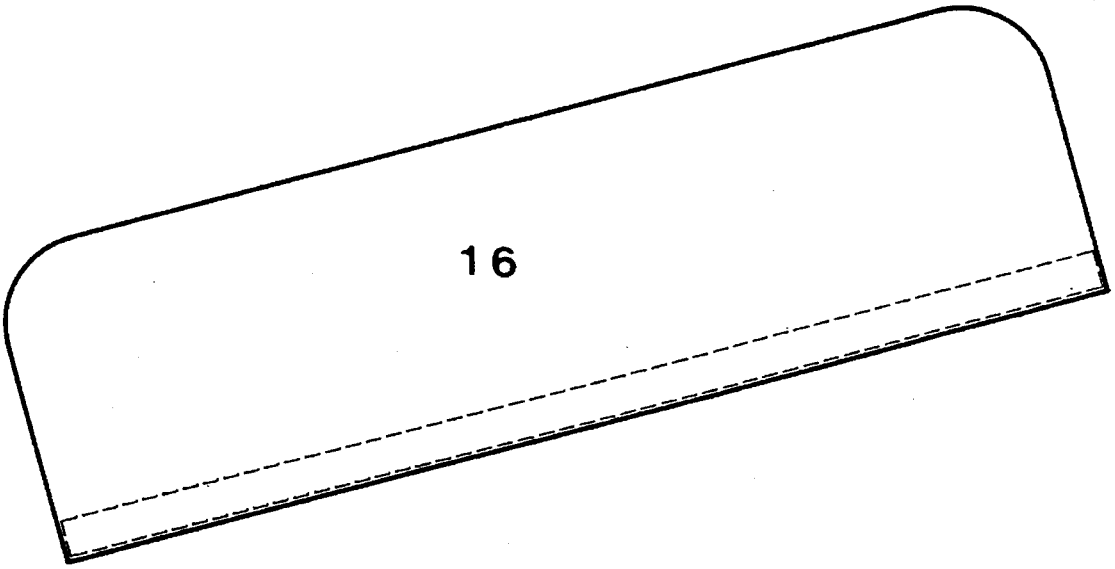
FIG. 5 is a side end view of hand-wrist pad.

Referring to FIG. 5 is number 16, this is just a pad for resting the user's back part of hand-wrist-forearm area to provide comfort and stability for the user. There are two of these pads, one will be connected to plate FIG. 4-A number 14 and FIG. 4-B number 15, both said pads should be the same length and width as said plates so as to provide maximum strength for pads so pads won't shift or flex. These pads, FIG. 5 number 16 should be about 2 inches thick so as to allow for adequate comfort for the user. The material for these pads, FIG. 5 number 16, should be durable yet pliable.

Figure 6:
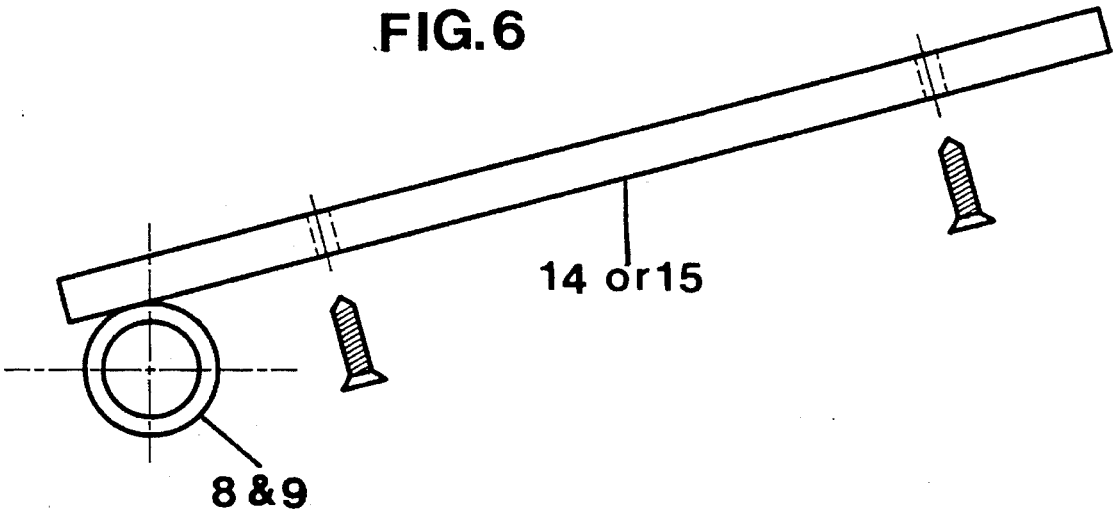
FIG. 6 is a side end view of bottom beam of apparatus and side end view of plate of present invention.

Referring to FIG. 6 numbers 14 and 15 is one in the same as FIG. 4-A number 14 or FIG. 4-B number 15, this FIG. 6 number 14 or 15 is a side view of said plate that a pad, FIG. 5 number 16, will be attached to: The reason for this approximate 20 degree angle is to allow end (end being opposite of beam FIG. 6 number 8 and 9) of pad to remain in constant contact with user's hand-wrist-forearm while this apparatus rotates on an inward arc motion.

Referring back to FIG. 1 the overall view; the distance between pads numbers 16 and handles numbers 17, should be about 2 inches so as to allow user while gripping handles to still be in contact with hand-wrist-forearm pads, so as to keep user from depending solely on his/her grip.

What is claimed:

1. A grip for an exercise device comprising:

a main support member having a lower substantially vertical portion and an upper angled portion angled upwardly away from the top of the lower portion at a first angle and forming a bend at the intersection of the upper angled and lower vertical portions;

a first upper beam having a first end attached at a first attachment point to said main support member adjacent said bend and a second free end;

a second upper beam having a first end attached at a second attachment point to said main support member adjacent said bend at a position diametrically opposed to said first attachment point and a second free end, wherein in each of said first and second upper beams extend upward from said main support member at second angle;

a first lower beam having a first end attached at a third attachment point to said main support member adjacent the lower end of said lower portion and a second free end;

a second lower beam having a first end attached at a fourth attachment point to said main support member adjacent the lower end of said lower portion at a position diametrically opposed to said third attachment point and a second free end, wherein in each of said first and second lower beams extend upward from said main support member at third angle; and a pair of plates, wherein one plate is attached to the second free end of the first lower beam and the other plate is attached to the second free end of the second lower beam.

2. The grip according to claim 1 wherein the first angle is approximately 20°.

3. The grip according to claim 1 wherein the second angle is approximately 11½°.

4. The grip according to claim 1 wherein the third angle is approximately 11½°.

5. The grip according to claim 1 wherein each plate further comprises padding.

6. The grip according to claim 1 wherein the plates are attached to the second free ends of the first and second lower beams at an upwardly extending fourth angle.

7. The grip according to claim 6 wherein the fourth angle is approximately 20°.

8. The grip according to claim 1 further comprising an attachment means on the upper end of the main support member for attaching the grip to an exercise device.

9. The grip according to claim 8 wherein the attachment means is a ring.

* * * * *